US005187463A

United States Patent [19]

Di Troia et al.

[11] Patent Number: 5,187,463

[45] Date of Patent: Feb. 16, 1993

[54] COMPACT TIME DELAY FUSE

[75] Inventors: Gary W. Di Troia, Saugus, Mass.; Paul M. Romani, Pawtucket, R.I.

[73] Assignee: Gould, Inc., Eastlake, Ohio

[21] Appl. No.: 833,760

[22] Filed: Feb. 11, 1992

[51] Int. Cl.[5] ..... H01H 85/04

[52] U.S. Cl. ..... 337/165; 337/163; 337/166

[58] Field of Search ..... 337/163, 164, 165, 166

[56] References Cited

U.S. PATENT DOCUMENTS 2,293,953 8/1942 Taylor .
2,321,711 6/1943 Taylor .
2,342,310 2/1944 Taylor .
2,386,094 10/1945 Duerkob .
2,613,297 10/1952 Laing .
2,657,294 10/1953 Laing .
2,688,677 9/1954 Laing .
2,694,124 11/1954 Laing et al. .
2,913,555 11/1959 McAlister .
3,144,534 8/1964 Baumbach .
3,489,977 1/1970 Smith, Jr. .
3,678,430 7/1972 Gaia .
3,681,731 8/1972 Kozacka .
3,863,188 1/1975 Knapp, Jr. .
4,032,877 6/1977 McAlister .
4,048,610 9/1977 Jacobs, Jr. .
4,210,893 7/1980 Hara .
4,321,574 3/1982 Pertici .
4,517,544 5/1985 Spaunhorst .
4,527,144 7/1985 Arikawa .
4,533,895 8/1985 Kowalik et al. .
4,559,513 12/1985 Gaia .
4,562,420 12/1985 Kowalik et al. .
4,593,262 6/1986 Krueger .
4,611,192 9/1986 Arora .
4,727,347 2/1988 Cambio et al. .
4,992,770 2/1991 Spalding et al. .
5,014,036 5/1991 Komoto .

*Primary Examiner*—Harold Broome
*Attorney, Agent, or Firm*—Fish & Richardson

[57] ABSTRACT

A time delay fuse including a fusible element for short circuit protection and a spring-loaded plunger partially contained in an enclosure and restrained by a solder mass for time-delayed overcurrent protection, the fusible element including a segment extending along the side of the enclosure in the space between the enclosure and the fuse casing.

16 Claims, 2 Drawing Sheets

COMPACT TIME DELAY FUSE

BACKGROUND OF THE INVENTION

The invention relates to time delay fuses.

Time delay fuses usually have a fusible element (e.g., a wire or thin strip) that quickly melts at short circuit conditions (e.g., 30 times the rated current) and another means to break the circuit slowly (e.g., solder that retains spring-loaded member and melts after the solder and adjacent heat mass have been raised to a specific temperature, the heat mass providing the delay) at lower overloads (e.g., 2 to 4 times rated current) to permit use with equipment having temporary surges such as motors. Time delay fuses are described in U.S. Pat. Nos. 4,533,895; 3,863,188; 2,321,711; 2,694,124; 4,048,610; 3,144,534; 4,562,420; 2,688,677; 2,613,297; 4,727,347; 2,293,953; 4,321,574; 4,517,544; 2,342,310; 2,386,094; 2,913,555; 3,681,731; 4,611,192; 4,593,262; 4,559,513; 2,657,294; and 4,992,770.

SUMMARY OF THE INVENTION

In one aspect, the invention features, in general, a time delay fuse including a fusible element for short circuit protection and a spring-loaded plunger partially contained in an enclosure and restrained by a solder mass for time-delayed low overload protection. A fusible element segment extends along the side of the enclosure in the space between the enclosure and the fuse casing. This efficiently uses this otherwise unused space to contain a fusible element segment, permitting use of an additional length of fusible element material and providing a high voltage rating in a small-size fuse.

In preferred embodiments, there also are fusible element segments between the ends of the enclosure and the fuse terminals at the ends of the fuse casing. There are three reduced area (i.e., "notch") sections in the fusible element segments along the side of the enclosure and two reduced area sections in each of the fusible element segments at the two ends. An end of the fusible element segment along the side of the enclosure is retained by the solder mass that retains the plunger, and one end of the plunger is soldered via a second solder mass to another fusible element segment.

In another aspect, the invention features, in general, a time delay fuse in which an insulator ring is provided around a spring-biased time-delay plunger between two solder masses soldered to the plunger. The insulator ring guarantees that there will not be conduction of electricity between the solder masses after the plunger has been activated and withdrawn through the ring.

Other advantages and features of the invention will be apparent from the following description of the preferred embodiment thereof and from the claims.

DESCRIPTION OF THE PREFERRED EMBODIMENT

Drawings

Structure

Figure 1:
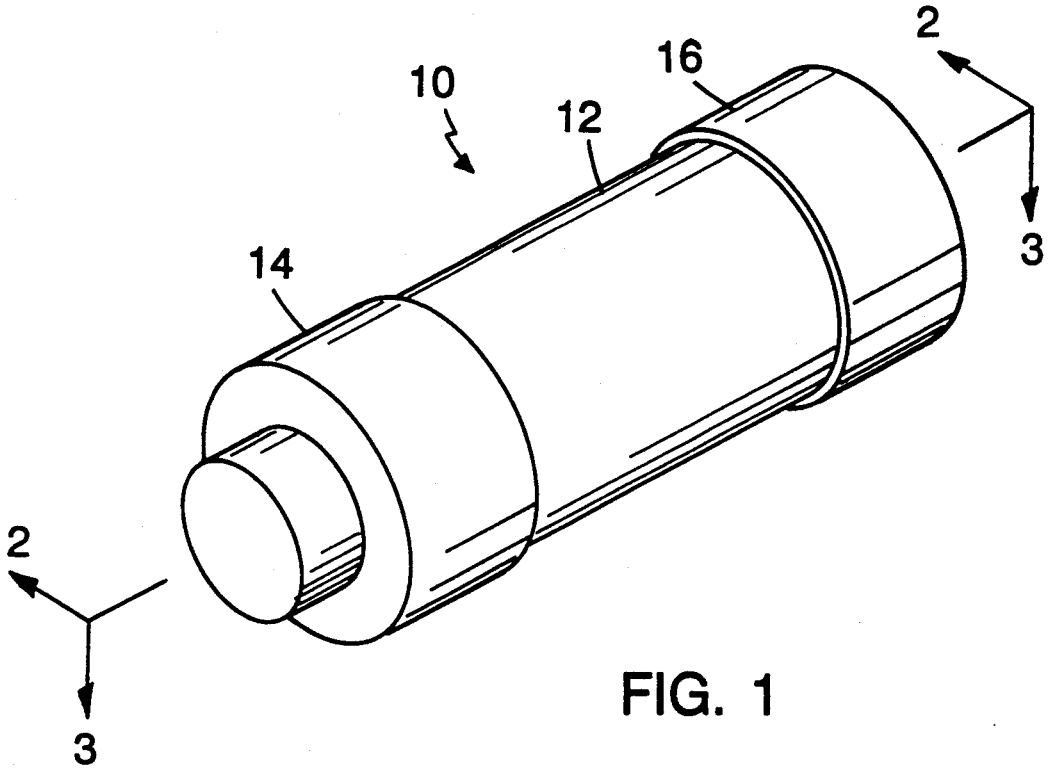
FIG. 1 is a perspective view of a time-delay fuse according to the invention.

Referring to FIG. 1, there is shown time-delay fuse 10 including cylindrical fuse casing 12 and terminals 14, 16 at the two open ends of fuse casing 12.

Figure 2:
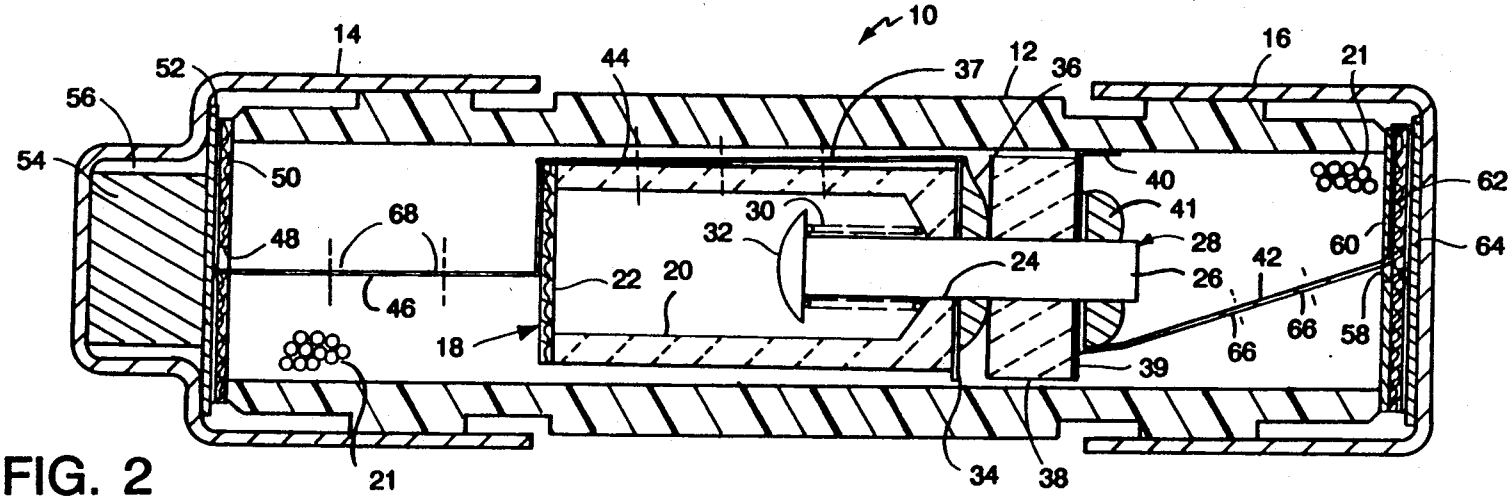
FIG. 2 is a sectional view, taken at 2—2 of FIG. 1, of the FIG. 1 fuse.
Figure 3:
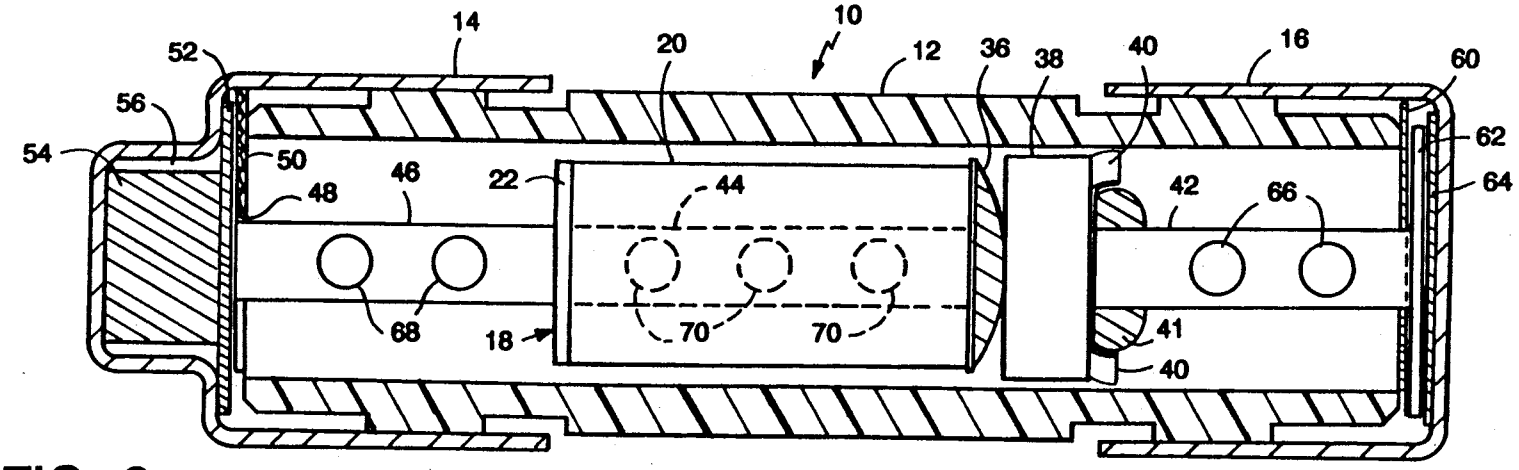
FIG. 3 is a partially sectional view, taken at 3—3 of FIG. 1, of the FIG. 1 fuse.

Referring to FIGS. 2 and 3, within fuse casing 12, enclosure 18 contains spring-biased components of a time delay mechanism to avoid interference by arch-quenching fill material 21 (e.g., 50/70 quartz), which fills the regions in fuse casing 12 beyond the ends of enclosure 18. Enclosure 18 includes ceramic cup 20 and fiber cover 22, which closes an end of ceramic cup 20. Shaft 26 of plunger 28 passes through opening 24 at the other end of cup 20. Spring 30 biases plunger head 32 away from opening 24 into enclosure 18. Brass soldering disk 34 surrounds opening 24 and supports solder mass 36, which retains plunger 28 and an end of fusible element 37. Insulator ring 38 (made up of an electrical insulator, e.g., resin impregnated canvas or ceramic) and 0.005" thick brass disk 39 surround plunger shaft 26 outside of solder mass 36. Disk 39 has bent tabs 40 to engage the inner surface of fuse casing 12 and centrally locate plunger shaft 26. Second solder mass 41 retains the end of fusible element segment 42.

Fusible element 37 is made up of two segments, fusible element segment 44, which extends along the side of enclosure 18, and fusible element segment 46, which is located between an end of fuse casing 12 and an end of enclosure 18. The end of fusible element segment 46 passes through slot 48 in fiber washer 50 and is sandwiched between washer 50 and solder preform 52. On the other side of solder preform 52 is brass plug 54, which is received in recess 56 of terminal 14. Terminal 14 is a rejection ferrule, used to guarantee that fuse 10 is mounted in the correct orientation and to prevent the installation the wrong type of fuse. Brass plug 54 provides electrical connection of fusible element segment 46 to terminal 14. At the other end of the fuse, the end of fusible element segment 42 passes through slot 58 in brass washer 60, wraps around fiber washer 62 and is sandwiched between washer 62 and solder preform 64.

Fusible element segments 42, 44, 46 are made of 0.086" wide and 0.00275" thick fusible element stock and have holes 0.0560" in diameter on ⅛" center lines to provide reduced area notch sections. Fusible element segments 42 and 46 each have two notch section holes 66, 68, respectively. Fusible element segment 44 has three notch section holes 70. Segments 42, 44 also have larger holes through which plunger shaft 26 passes.

The clearance between cup 20 and the inner surface of casing 12 is sufficiently large to accommodate fusible element segment 44 without damaging it during insertion into casing 12 during manufacture. Preferably the clearance is also sufficiently small to prevent a substantial amount of fill material from entering the region. With the fusible element stock and fill material employed in fuse 10, a clearance of about 0.015" at each side meets both objectives.

Manufacture

In manufacture, shaft 26 of plunger 32 is fed through spring 30, hole 24 of cup 20, brass disk 34 and the larger hole at the end of fusible segment 44 and is then maintained in a spring-biased position while solder mass 36 is melted in place. The end of shaft 26 is then fed through insulator ring 38, disk 39, the larger hole in fusible element segment 42 and a solder preform, which is then melted to provide solder mass 41 and hold these components in place. The resulting subassembly is inserted in fuse casing 12, with the open end of cup 20 and the corresponding end of fuse casing 12 directed upward.

Fiber cover 22 is then placed over the open end of cup 20, and fusible element 37 is bent over fiber cover 22 to assist in holding it in place. (Adhesive could also be used to hold cover 22 in place.) Arc quenching fill material 21 is added to the region around fusible element segment 46. The end of segment 46 is fed through slot 48 and bent sideways, and solder preform 52 is added. Terminal 14 and plug 54 are then added, and the ends of terminal 14 are crimped. (FIGS. 2 and 3 show terminal 14 before crimping.) Fuse casing 12 is then inverted, and arc quenching fill material 21 is added to the region surrounding fusible element segment 42. The end of segment 42 is fed through slot 58, wrapped around washer 62 and sandwiched between it and solder preform 64. Terminal 16 is added and crimped onto the end of casing 12. (FIGS. 2 and 3 show terminal 16 before crimping.) Solder preforms 52 and 64 are then melted by applying flames to terminals 14 and 16.

Operation

In operation, fusible element segments 42, 44, 46 provide protection under short circuit conditions, and the solder masses 36, 41 and spring-loaded plunger 28 provide time-delay release under overload conditions.

During a short circuit condition, the notch sections at holes 66, 68, 70 fuse first. Because the fusible element segments extend over the full length of fuse casing 12, the arcing and pressures developed are spread evenly throughout the interior, reducing the severity of conditions within the fuse. The three notches at holes 68 are within the restricted area where fusible element segment 44 passes between cup 20 and the inner surface of fuse casing 12. These three notches fuse rapidly, diminishing the duration of arcing and overall generation of internal pressure, avoiding catastrophic operation. Fill material 21 helps quench the arcing produced by the fusible element segments. Also, having notch sections at holes 68 fuse in a tight space generates localized high pressures tending to quench arcs quickly.

During a low overcurrent condition, the resistance due to the conductive components heats the interior of the fuse. The generated heat is dissipated by the mass of solder masses 36 and 41, cup 20, plunger 28, insulator ring 38, and fill material 21. As the overload condition continues, the generated heat surpasses the dissipation that these components provide and eventually melts solder masses 36 and 41. Upon melting of the solder, plunger 28 is loosened, and spring 30 is able to extend, pushing plunger head 32 against cover 22 and withdrawing shaft 26 into cup 20, opening the circuit at insulator ring 38. Insulator ring 38 prevents the two solder masses and other conductive components from touching each other or from being in close enough proximity to permit electricity to be conducted between them from one terminal to the other.

The seven notch sections of fuse 10 provide 600-volt capacity in a very small casing size (1½" long casing) by efficiently using the otherwise unused space along the side of enclosure 18 to contain fusible element segment 44 and thereby provide three additional notch sections.

Other embodiments of the invention are within the scope of the appended claims.

What is claimed is:

1. A time-delay fuse comprising a fuse casing having openings at two ends thereof, terminals at said two ends of said casing, an enclosure that is within said fuse casing and is sized to leave a space between said enclosure and said casing, a spring within said enclosure, a plunger having a first end engaged by said spring in said enclosure and a second end extending from said enclosure, a first solder mass engaging said plunger and restraining movement of said plunger into said enclosure, said solder melting at low overload conditions, and a first fusible element segment extending from one side of said enclosure to the other in said space between said enclosure and said fuse casing, said plunger and said first fusible element segment being electrically connected between said terminals, wherein said first fusible element segment having a reduced area section.

2. The fuse of claim 1 further comprising a second fusible element segment that is located between one end of said enclosure and an end of said fuse casing, said second fusible element being electrically connected between said two terminals, and wherein said second fusible element segment has a respective reduced area section.

3. The fuse of claim 2 further comprising a third fusible element segment that is located between the other end of said enclosure and the other end of said fuse casing, said third fusible element segment being electrically connected between said two terminals, and wherein said first third fusible element segment has a respective reduced area section.

4. The fuse of claim 1 wherein said first fusible element segment has three reduced area sections.

5. The fuse of claim 2 wherein said first fusible segment has three reduced area sections, and said second fusible element segment has two reduced area sections.

6. The fuse of claim 3 wherein said first fusible segment has three reduced area sections, said second fusible element segment has two reduced area sections, and said third fusible element segment has two reduced area sections.

7. The fuse of claim 2 wherein said second end of said plunger is electrically connected between said first and second fusible element segments.

8. The fuse of claim 7 wherein one end of said first fusible element segment is retained by said first solder mass.

9. The fuse of claim 8 further comprising a second solder mass connecting said second fusible element segment to said second end of said plunger.

10. The fuse of claim 9 further comprising an insulator ring around said plunger and between said first and second solder masses.

11. The fuse of claim 1 wherein said fuse casing and said enclosure are cylindrical.

12. The fuse of claim 11 wherein said enclosure includes a cup member and a cover closing one end thereof.

13. A time-delay fuse comprising a fuse casing having openings at two ends thereof, terminals at said two ends of said casing, a spring-biased plunger within said casing and electrically connected between said two terminals, a first solder mass engaging said plunger and restraining movement of said plunger, said solder mass melting under overload conditions, a second solder mass making electrical connection between said plunger and a said terminal, said solder mass melting under overload conditions, said plunger being released when both said first solder mass and said second solder mass have melted, thereby breaking said electrical connection when said plunger moves owing to spring biasing, and an insulator ring around said plunger between said first and second solder masses.

14. The fuse of claim 13 wherein said plunger has a portion with a circular cross-section passing through said ring, and wherein said ring has a cylindrical surface surrounding said portion of said plunger.

15. The fuse of claim 13 wherein said second solder mass electrically connects said plunger to said terminal via a fusible element.

16. The fuse of claim 13 further comprising an enclosure within said casing, said enclosure having an opening through which said plunger passes, said plunger being mounted to be move into said enclosure after being released by said solder masses.

* * * * *